United States Patent [19]

Beckerman

[11] 4,113,099

[45] Sep. 12, 1978

[54] WOOD CARVING KIT

[76] Inventor: Arthur Beckerman, 45 Hutchins St., Auburn, Me. 04210

[21] Appl. No.: 838,533

[22] Filed: Oct. 3, 1977

[51] Int. Cl.[2] ..... B65D 69/00

[52] U.S. Cl. ..... 206/575; 35/26; 144/309 A; 144/316

[58] Field of Search ..... 206/223, 1.7, 575; 35/26, 66; 144/309 A, 316, 323; 40/152, 160

[56] References Cited

U.S. PATENT DOCUMENTS

| | | | |
|---|---|---|---|
| 26,898 | 1/1860 | Forest | 144/309 A |
| 2,383,567 | 8/1945 | Rudnick | 35/26 |
| 3,123,919 | 3/1964 | Meador | 35/26 |
| 3,704,531 | 12/1972 | Seals | 35/26 |
| 3,742,620 | 7/1973 | Knoll | 35/26 |
| 3,826,020 | 7/1974 | Zutz | 35/26 |

FOREIGN PATENT DOCUMENTS

| | | | |
|---|---|---|---|
| 1,104,669 | 2/1968 | United Kingdom | 144/309 A |

*Primary Examiner*—William Price
*Assistant Examiner*—Bruce H. Bernstein
*Attorney, Agent, or Firm*—Weingarten, Maxham & Schurgin

[57] ABSTRACT

A wood carving kit comprising a wood block having a carving surface on which a pattern to be carved is provided, and an integral frame portion around the periphery of the block and separated from the carving surface by a surrounding groove. The groove extends inwardly from the carving surface by an amount defining the finished depth of the carving and accommodates one or more guard elements removably disposable therein which shield the frame portion from damage from the carving tools.

8 Claims, 6 Drawing Figures

WOOD CARVING KIT

FIELD OF THE INVENTION

This invention relates to wood carving and more particularly to a wood carving kit for the formation of a carved item in a simple and attractive manner.

BACKGROUND OF THE INVENTION

Wood carving as a hobbycraft is appealing to many people but such individuals often become frustrated or confused by lack of project organization and the need for an array of items in order to work on and complete a particular project. In relief carving, a suitable block of wood must be obtained, a pattern or picture to be carved must then be applied to and centered on the carving surface and the carving then made to a finish depth to be ascertained and often guessed at by the carver. After completion, the carved block is usually desired to be framed by appropriate frame stock which must be fitted and attached to the sides of the block. All of this, to a novice or inexperienced carver, can be frustrating and likely results in work of a quality less than that to which the carver is capable if provided with proper guidance.

SUMMARY OF THE INVENTION

In brief, the present invention provides a wood carving kit with which a novice or inexperienced carver can readily achieve a relief carving to correct finish depth and in a wood block having a preformed integral frame for display of the completed work. The invention comprises a wood block having a carving surface on which a pattern to be carved is printed or otherwise provided in intended placement within the confines of the surface. A frame portion integral with the block and preformed to an intended style is provided around the periphery of the block and is separated from the carving surface by a surrounding groove. This groove extends inwardly from the carving surface by an amount defining the finish depth of the carving to be made in the carving surface. One or more guard elements are provided of a size and configuration to be removably disposed in the groove. The guard element when placed fully in the groove, extends above the carving surface and serves to shield the frame portion from carving action in the surface adjacent that element and provides a tool stop to prevent damage to the frame which can occur by slippage of a carving tool or by over zealous use of the tool.

DESCRIPTION OF THE DRAWINGS

The invention will be more fully understood in the following detailed description taken in conjunction with the accompanying drawings in which.

DETAILED DESCRIPTION OF THE INVENTION

Figure 1:
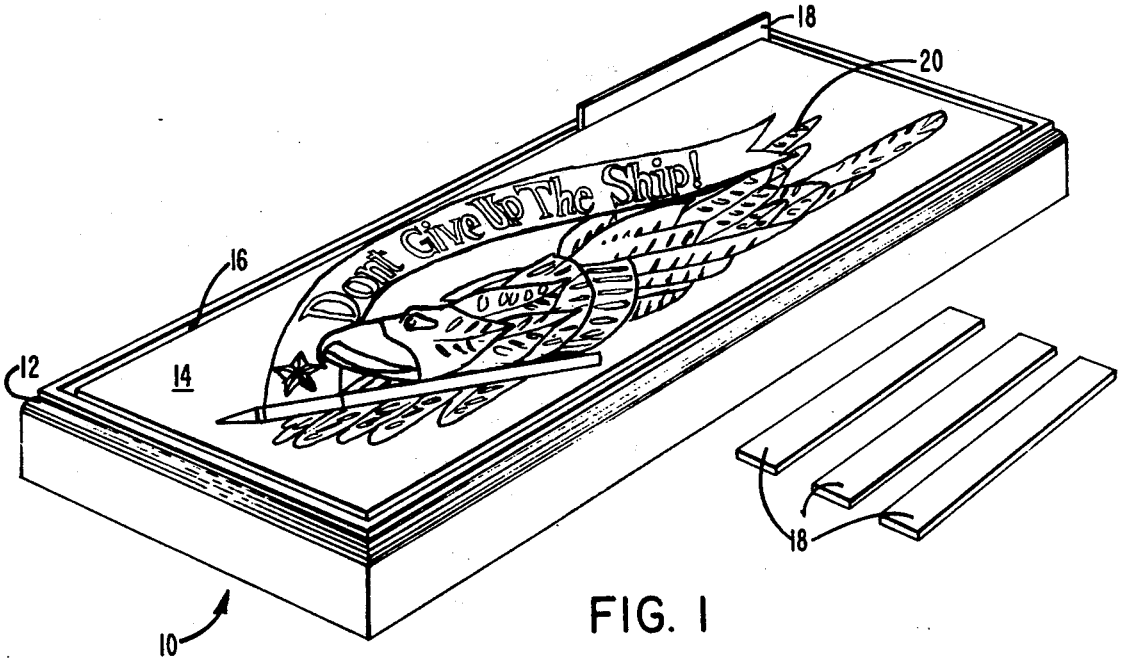
FIG. 1 is a pictorial view of a wood carving kit according to the invention.
Figure 2:
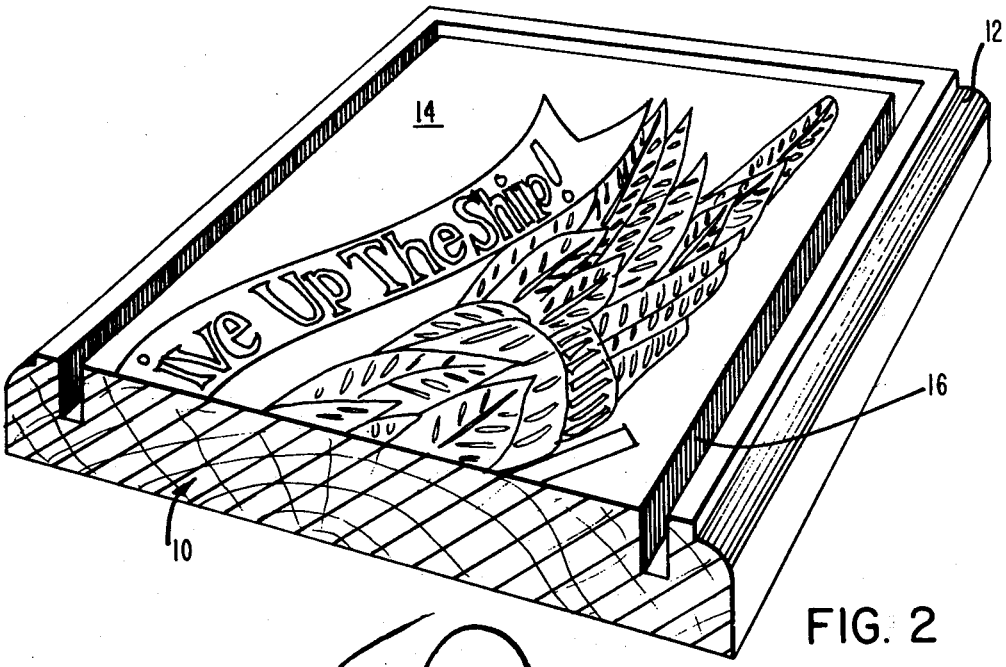
FIG. 2 is a cutaway pictorial view of the novel wood carving kit.

Referring to FIGS. 1 and 2, there is shown a wood carving kit in accordance with the invention and comprising a solid wood block 10 of rectangular configuration and having a frame portion 12 integrally formed with the block around the four sides thereof. The frame portion is milled to provide an intended preformed frame molding style. A carving surface 14 is provided by the upper surface of block 10 and is separated from frame portion 12 by a surrounding groove 16 of rectangular cross section and which extends along all four sides of the carving surface and which extends inwardly from the carving surface to a predetermined depth defining the finish depth to which a carving is to be made.

One or more guard elements 18 are provided of a size and configuration to be removably disposed within groove 16 and movable to intended portions of the groove. In the illustrated embodiment, the guard elements 18 are each rectangular wood strips of a thickness to be slidably inserted in groove 16. The elements 18 are of a height to upwardly extend, when fully inserted into groove 16, above the carving surface by a predetermined amount to provide a shield against damage to the frame portion 12 from carving action. One element is shown in FIG. 1 installed in groove 16 extending from a corner along the top side of block 10. A pattern 20 is printed, such as by silk screening, or otherwise provided on carving surface 14 and is centered or otherwise placed in intended position within the carving surface. The pattern 20, here illustrated as a classical nautical eagle, is of the item to be carved into the block and to the finish depth of the carving denoted by the depth of the surrounding groove 16. By virtue of the invention, the finish depth, that is, the maximum depth to which the carving is to be made, is defined by the surrounding grooves and a visual reference depth is always present to assure carving to the correct maximum depth.

Figure 3:
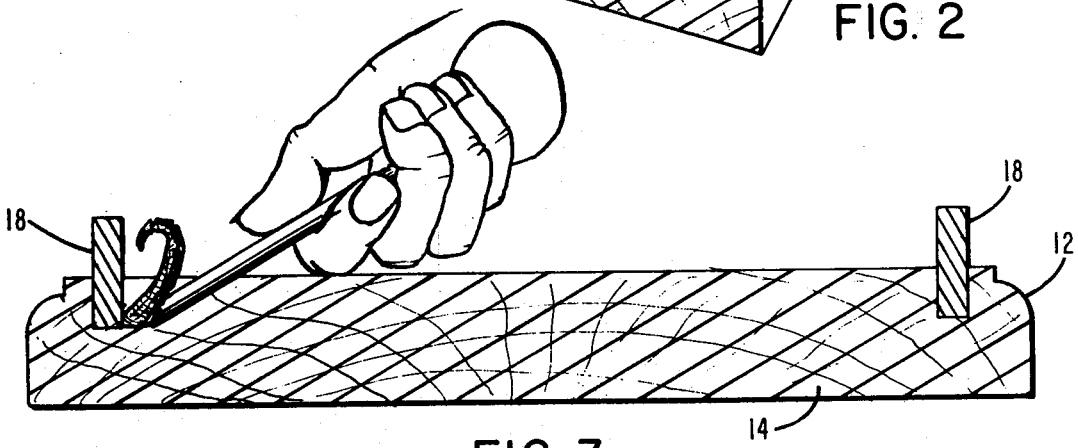
FIG. 3 is a sectional elevation view of the novel wood carving kit illustrating a carving operation.

In carving a pattern with the novel kit, one or more guard elements 18 are disposed within groove 16 at adjacent portions of the carving surface in which work is to be performed. The guard elements can be placed as desired by a user in portions of groove 16 to isolate the portion of the carving surface 14 being carved at a particular time from the frame portion 12. With a guard element disposed in the groove, carving can be performed in the adjacent carving surface, as depicted in FIG. 3, without damage or danger of damage to the frame portion 12 which, in the absence of a guard element, could be caused by slippage of the gauge, chisel or other carving tool, or inadvertent extension of a carving stroke into the frame portion. In addition, the finish carving depth is readily denoted by the depth of groove 16 and carving can be continued downwardly into the block until the finish depth is reached. The guard element extends to the full carving depth and thus serves as a shield for the entire carving activity from the surface down to finish depth. As the carving continues along different areas of the block, the guard elements 18 can be moved to the area then under work to provide shielding for that area.

Figure 4:
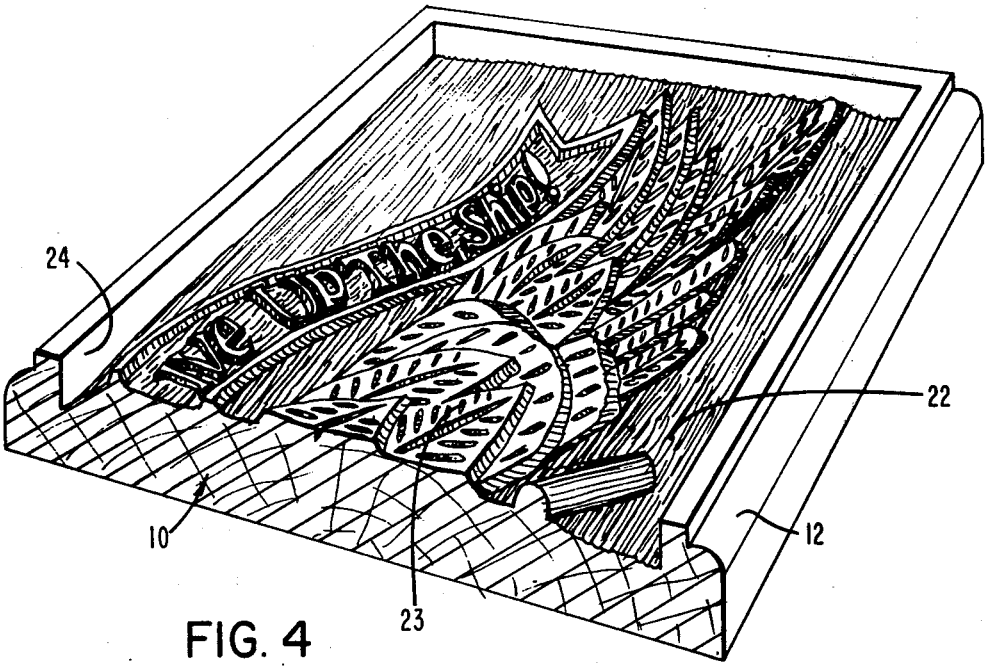
FIG. 4 is a cutaway pictorial view of the novel wood carving kit illustrating a completed carving.

A completed carving is illustrated in FIG. 4 and shows outer portions 22 of the carving 23 which are at a finish depth equal to the depth of groove 16 which was provided between the carving surface and the frame portion. Other portions of the carved pattern extend to different intermediate depths in accordance with the particular item or figure and the aesthetic appearance desired. The completed carving exhibits a smooth, unmarred border 24 and frame portion 12 on all sides of the carving to delineate the work and provide appropriate display thereof, all without further labor. Upon completion of the carving activity, the carver need only stain or paint the work.

Figure 5:
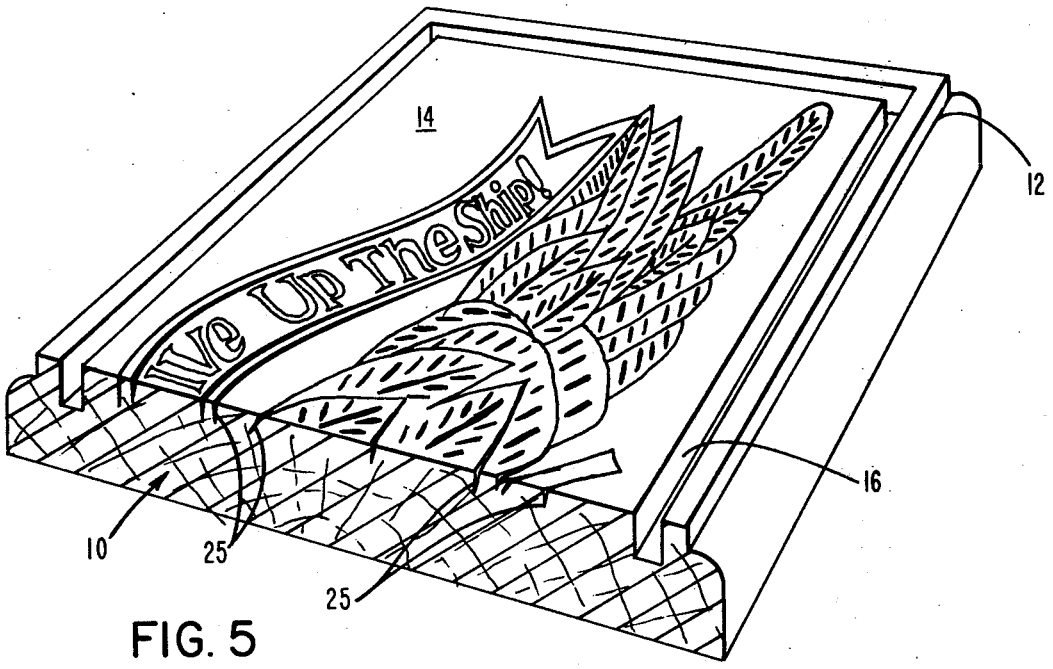
FIG. 5 is a cutaway pictorial view of an alternative embodiment of the invention illustrating a pattern cut to a selected depth in the carving surface.

An alternative embodiment of the invention is shown in FIG. 5 in which a pattern 20*a* is cut into the carving surface 14 to an intended depth, rather than being printed at the surface. The pattern 20*a* is therefore composed of an array of thin grooves 25 cut into the carving surface to further delineate the pattern to be carved and to provide starting grooves from which carving can be commenced. This cut pattern can be provided by use of a suitable cutting die. The pattern may be cut only along its outline, or along the major pattern lines thereof or along all of the pattern lines.

Figure 6:
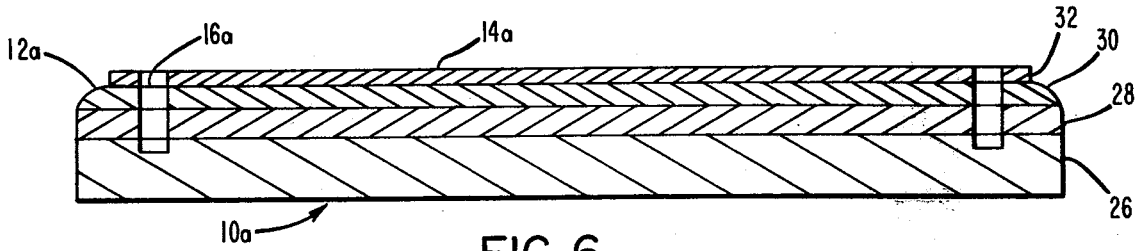
FIG. 6 is a sectional elevation view of a further embodiment of the invention employing a laminated wood block.

A further embodiment of the invention is illustrated in FIG. 6 and includes a wood block 10*a* of laminated construction having a plurality of layers of wood each of a distinctive characteristic, such as surface appearance, grain or color. In this illustrated embodiment, four wood layers 26, 28, 30 and 32 are shown, each of a predetermined thickness and laminated together to provide a wood block of intended overall thickness. A groove 16*a* is provided around the periphery of the carving surface 14*a* as above-described and separating the carving surface from the surrounding frame portion 12*a* and extending to a finish depth for the carving. A carving made in the laminated block will be composed of portions extending to various depth in the several layers. As a result, the completed carving will have portions of different appearance depending upon the wood layer or layers which have been exposed in that area of the carving.

It will be appreciated that the invention is not limited to the specific embodiments shown and described herein. For example, the wood block and its frame portion can be of many different configurations other than the rectangular one illustrated and can include curved as well as straight sides. If a block having a curved side is employed, the surrounding groove is similarly curved for accommodation of a curved guard element. The guard elements can also be of various materials and configuration. Preferably the guard elements should be made of wood or other material which will not dull the cutting edge of tools which may come into engagement therewith. A single guard element can also be provided to fit within the entire surrounding groove, or a guard element can be provided of flexible material to fit curved as well as straight grooves of an associated carving block. Accordingly, the invention is not to be limited except as indicated in the appended claims.

What is claimed is:

1. A wood carving kit comprising:

a unitary block of wood having a carving surface;

a frame portion around the periphery of the block and integral with the block;

a groove around the periphery of the carving surface and extending inward from that surface to a predetermined depth in the block defining the maximum carving depth of a pattern to be carved into the carving surface, the groove separating the carving surface from the frame portion;

a pattern provided in predetermined placement on the carving surface and depicting an item to be carved in accordance with that pattern; and at least one guard element sized and configured to be removably disposed in the groove and when fully inserted therein to extend above the carving surface by a predetermined amount, and operative to shield the frame portion from possible damage by a carving tool being used in portions of the carving surface adjacent the guard element.

2. The wood carving kit of claim 1 wherein said pattern is printed on the carving surface.

3. The wood carving kit of claim 1 wherein said pattern is cut into the carving surface to delineate areas to be carved.

4. The wood carving kit of claim 1 wherein said at least one guard element includes a generally rectangular strip of material which will not dull a carving tool coming into engagement with the strip and sized and configured to be disposed and slidably movable in said groove.

5. The wood carving kit of claim 1 wherein said at least one guard element includes a unitary guard element adapted to be removably disposed within the entire peripheral groove.

6. The wood carving kit of claim 1 wherein said groove includes a curved portion and said guard element is configured to fit within the curved portion of the groove.

7. The wood carving kit of claim 1 wherein said block of wood is laminated of a plurality of layers each of a wood having a distinctive characteristic, each of said wood layers being disposed at an intended depth of the completed carving.

8. The wood carving kit of claim 1 wherein said groove is of rectangular cross section.

* * * * *